US011992741B2

(12) United States Patent
Ubys et al.

(10) Patent No.: US 11,992,741 B2
(45) Date of Patent: May 28, 2024

(54) GAIT TRAINER FOR TRAINING OF NEUROMUSCULAR FUNCTIONS

(71) Applicant: V. Guldmann A/S, Aarhus N (DK)

(72) Inventors: Laurynas Ubys, Skodstrup (DK); Jens K. Andersen, Arhus C (DK); Stine H. Stensgaard, Arhus V (DK); Morten Rathke, Sporup (DK)

(73) Assignee: V. GULDMANN A/S, Aarhus N (DK)

( * ) Notice: Subject to any disclaimer, the term of this patent is extended or adjusted under 35 U.S.C. 154(b) by 213 days.

(21) Appl. No.: 17/618,278

(22) PCT Filed: Jun. 15, 2020

(86) PCT No.: PCT/DK2020/050169
§ 371 (c)(1),
(2) Date: Dec. 10, 2021

(87) PCT Pub. No.: WO2020/249177
PCT Pub. Date: Dec. 17, 2020

(65) Prior Publication Data

US 2022/0305362 A1 Sep. 29, 2022

(30) Foreign Application Priority Data

Jun. 13, 2019 (DK) ..... PA 2019 70372

(51) Int. Cl.
*A63B 71/00* (2006.01)
*A63B 69/00* (2006.01)

(52) U.S. Cl.
CPC ..... *A63B 69/0064* (2013.01); *A63B 71/0054* (2013.01); *A63B 2071/0072* (2013.01);
(Continued)

(58) Field of Classification Search
CPC ..... A63B 71/0054; A63B 69/0064
See application file for complete search history.

(56) References Cited

U.S. PATENT DOCUMENTS 6,027,429 A 2/2000 Daniels
7,883,450 B2 2/2011 Hidler
(Continued)

FOREIGN PATENT DOCUMENTS

EP 1595522 A1 11/2005
RU 2 409 342 C1 1/2011
(Continued)

*Primary Examiner* — Kesha Frisby
(74) *Attorney, Agent, or Firm* — Schmeiser, Olsen & Watts, LLP

(57) ABSTRACT

The present invention relates to a method for training of neuromuscular functions using a gait trainer comprising an electrical motor, a weight sensor and a cable and a gait trainer therefore.
The method may comprise an act of determining a counterbalance weight to be applied to the cable by the electrical motor and an act of measuring with the weight sensor an actual applied weight to the cable by the patient, wherein a drive direction of the electrical motor is determined based on comparing the counterbalance weight with the measuring of the actual applied weight to the cable by the patient.
The gait trainer may comprise a hoist system with a rotatable cable drum and a cable to wind or rewind the cable around a rotatable cable drum in accordance with the drive direction set, based on the compared counterbalance weight with the measuring of the actual applied weight to the cable by the patient.
The gait trainer may further comprise an electrical motor adapted for axial engagement with the rotatable cable drum and adapted to drive the rotatable cable drum in a drive direction. The gait trainer may further comprise a weight sensor, a control unit, a processor and a motor controller.
The hoist system may be freely suspended by the weight sensor.

14 Claims, 6 Drawing Sheets

(52) U.S. Cl.
CPC ... *A63B 2071/0081* (2013.01); *A63B 2220/52* (2013.01); *A63B 2230/015* (2013.01)

(56) References Cited

U.S. PATENT DOCUMENTS

| | | | |
|---|---|---|---|
| 9,510,991 | B2 | 12/2016 | Stockmaster et al. |
| 9,801,775 | B2 | 10/2017 | Vallery et al. |
| 10,307,624 | B2 | 6/2019 | Strohman |
| 2009/0318267 | A1 | 12/2009 | Park et al. |
| 2012/0238921 | A1 | 9/2012 | Kuehne et al. |
| 2016/0339299 | A1 | 11/2016 | Gronachan et al. |

FOREIGN PATENT DOCUMENTS

| | | | |
|---|---|---|---|
| RU | 2 563 432 | C1 | 9/2015 |
| RU | 2673764 | C1 | 11/2018 |
| WO | 2016/126851 | | 8/2016 |

GAIT TRAINER FOR TRAINING OF NEUROMUSCULAR FUNCTIONS

RELATED APPLICATIONS

This patent is a National Entry Phase of PCT Patent Application PCT/DK2020/050169 filed Jun. 15, 2020, which claims priority to Denmark application DK201970372 filed Jun. 13, 2019. All references cited in this section are incorporated here by reference in their entirety.

FIELD OF THE INVENTION

The present invention relates to a gait trainer for training of neuromuscular functions comprising:

- a hoist system with a rotatable cable drum, a cable adapted to be wound around the rotatable cable drum and with a cable end adapted for interaction with a patient;
- an electrical motor adapted for axial engagement with the rotatable cable drum and adapted to drive said rotatable cable drum in a forward and in a reverse drive direction for unwinding or winding the cable on the cable drum;
- a weight sensor adapted for outputting a qualitative weight sensor signal;
- a control unit;
- a processor adapted for receiving the qualitative weight sensor signal, said processor being configured for calculating and outputting a motor drive control signal,
- a motor controller adapted to receive the motor drive control signal.

The invention also relates to a method for training of neuromuscular functions using such gait trainer comprising an electrical motor, a weight sensor and a cable.

When using the gait trainer, the method may comprise an act of determining a counterbalance weight to be applied to the cable by the electrical motor and an act of measuring with the weight sensor an actual applied weight to the cable by the patient, wherein a drive direction of the electrical motor is determined based on comparing the counterbalance weight with the measuring actual applied weight to the cable by the patient.

The gait trainer may comprise a hoist system with a rotatable cable drum and a cable to wind or rewind the cable around a rotatable cable drum in accordance with the drive direction set, based on the compared counterbalance weight with the measuring actual applied weight to the cable by the patient.

The gait trainer may further comprise an electrical motor adapted for axial engagement with the rotatable cable drum and adapted to drive the rotatable cable drum in a drive direction. The gait trainer may further comprise a weight sensor, a control unit, a processor and a motor controller.

The hoist system may be freely suspended by the weight sensor.

BACKGROUND OF THE INVENTION

Rehabilitation usually takes the form of a training process over a set period of time, taking as its starting point the functional skill level of the individual patient. Rehabilitation exercises can involve moving, positioning, strength training, stretching, active movement exercises and practising everyday activities. From a purely therapeutic perspective, the objective of rehabilitation is to maintain and increase functional skills as far as possible.

Rehabilitation processes often demand a great deal of the professional therapist, who is required to compensate for the patient's lack of mobility and inability to help himself/herself.

Confidence and security are essential for rapid rehabilitation.

Extended periods of hospitalisation with required protracted periods in bed can have serious consequences on the patient's health and well-being. Lying immobile increases the risk of blood clots forming in the lungs, and of skin complications such as pressure ulcers.

Loss of muscle mass and strength are other complications commonly associated with long-term hospitalisation, and these issues can actually affect both the length of hospitalisation and the patient's ability to function after discharge.

For hospitalised patients, long periods of immobility can increase the risk of:

- Respiratory complications such as pneumonia, atelectasis and pulmonary embolism
- Constipation
- Incontinence
- Tissue damage and pressure ulcers
- Blood clots in the legs (deep vein thrombosis)
- Reduced muscle mass and muscle strength
- Reduced physical fitness
- Diminished balance, especially among elderly patients It is therefore extremely important to mobilise patients as early as possible—ideally during the period of hospitalisation.

Early mobilisation will enable patients to commence rehabilitation sooner, which will improve convalescence after an operation by boosting blood circulation and reducing the risk of infection and other complications.

Early mobilisation and rehabilitation are defined as positioning/repositioning exercises and physical activity, and spending more time out of bed—walking around or simply standing up. Other activities can include simple everyday routines such as combing hair, washing face and hands with a wet flannel, exercises in and/or next to the bed, balance training and walking around the bed.

However, a number of challenges are linked to early mobilisation due to an increased risk of falls, unintended movements and a feeling of insecurity by the patient. Such challenges may include a major need for physical assistance, and risk of injury to care staff and therapists.

Common lifting and moving tasks in connection with hospitalisation and early mobilisation may include:

- Helping patients into a sitting position in order to test their reactions, reflexes,
- protective responses
- Supporting the sitting position
- Moving patients between bed, chair, examination couch, etc.
- Lifting the upper body for positioning supports, pillows and the like
- Lifting the hips when making the bed under the patient
- Lifting extremities
- Toilet visits (using a toilet chair, if necessary)
- Transition from one position to another
- Moving patients from sitting to standing position, and vice versa
- Standing balance/sitting balance
- Reactions, reflexes, protective response in upright position
- Shifting weight
- Gait training
- Exercises in the bed

OBJECT OF THE INVENTION

An objective of this invention is to disclose a gait trainer for training of neuromuscular functions for early mobilisation and which gait trainer can be adjusted according to the progress in the patient's recovery and gained strength.

DESCRIPTION OF THE INVENTION

An object of the invention may be achieved by a gait trainer mentioned by way of introduction and defined in the preamble of claim 1 and which is peculiar in that the processor is adapted for establishing the calculated drive direction in the motor based on the received qualitative weight sensor signal and based on the result of comparing the actual qualitative weight signal with a counterbalance weight determined prior to beginning the training, and that said motor controller is adapted to establish the calculated drive direction in the motor such that the determined counterbalance weight applied to the cable by the electrical motor is maintained at a constant value, and that the hoist system is freely suspended by the weight sensors as the gait trainer comprises two weight sensors wherein the weight sensors are arranged side-mounted on the hoist system, such that the built-in height dimension of the gait trainer is reduced.

The gait trainer comprises two weight sensors. The weight sensors are arranged side-mounted on the hoist system, such that the built-in height dimension of the gait trainer is reduced.

Reducing the height dimensions may be important in regard to achieving a broader usability of the gait trainer, especially in existing rooms and/or in existing equipment.

Due to the gait trainer being suitable for performing standing exercises, which could include balancing exercises, walking and/or running, the height of the hoist system and the height of the patient should be considered in regard to installing and using the gait trainer.

Furthermore, the exercises may include additional equipment which adds to the height needed for performing the exercises e.g. treadmills, balancing boards, steps, balancing balls etc.

When using the gait trainer, the method may comprise an act of determining a counterbalance weight to be applied to the cable by the electrical motor.

The method may be used for training of neuromuscular functions.

The method may further comprise an act of measuring with the weight sensor an actual applied weight to the cable by the patient, an act of comparing the actual applied weight with the determined counterbalance weight, and an act of instructing a motor controller of a drive direction by providing a motor drive control signal based on the result of comparing the actual applied weight with the determined counterbalancing weight.

The acts of measuring an actual applied weight to the cable by the patient, of comparing the actual applied weight with the determined counterbalance weight, and of instructing a motor controller of a drive direction may be continuously performed such that the determined counterbalance weight applied to the cable by the electrical motor is maintained at a constant value.

One effect of this embodiment may be that the gait trainer may be operated in a dynamic mode, where the counterbalance weight is continuously maintained during training. Hence, the training load to be exerted by the patient may also be maintained at a constant level.

One effect of this embodiment may be to provide a training method wherein the patient may train natural movements but with a reduced body weight. This may in other settings be accomplished by training in water. However, this may in many circumstances not be an option due to the facilities and/or the condition of full-body contact with water e.g. in regard to the patient's complications.

Another effect of the embodiment may be to provide a training method which supports standing exercises such as balancing, walking and/or running.

The training method may be provided by incorporating the method steps in existing patient hoist systems having an electrical motor, a weight sensor and a cable being adapted as described above, as patient hoist systems are per se adapted for winding and unwinding a cable in order to perform lifting and lowering of a patient.

The cable may at the cable end be mounted with a buckle for further attachment to a sling, strap or comparable units adapted for holding the patient or to be worn by the patient. Such holding or wearing units may already be used in connecting with existing patient hoist systems. Alternatively, new forms or shapes of holding or wearing units may be retrofitted to existing patient hoist systems by use of connecting units fitting with buckles of existing patient hoist systems.

In one aspect of performing the method, the user may determine the desired weight load prior to beginning the training. The desired weight load may be as a counterbalance weight or alternatively a training load to be exerted by the patient. After determining the desired weight load, the training can start as soon as the patient is coupled to the cable e.g. by entering a sling coupled to the cable end. A further effect may be that the desired weight load may be easy and accurate to set in subsequent training sessions. Subsequent training sessions may other be dependent on the progress and execution of the single exercises in previous training sessions.

In an aspect, the method may be adapted for a stepwise change in the training load to be exerted by the patient during a training session. Alternatively, the training may be adapted to change between a static mode and a dynamic mode, where, in the static mode, the counterbalance weight may not be adjusted in response to the applied force by the patient. In the dynamic mode, the counterbalance weight may on the contrary be adjusted in response to the actual applied weight to the cable by the patient.

In one embodiment, the method may comprise further acts of providing a weight of a patient and determining the counterbalance weight as a percentage of the provided weight of the patient. The difference between the provided weight of the patient and the counterbalance weight may be the training load to be exerted by the patient.

In one aspect, the counterbalance weight may be determined by setting a training load to be exerted by the patient and then calculating the difference between the provided weight of the patient and the training load to be exerted by the patient.

The training load may be expressed in percentage of the patient's weight.

This embodiment may provide the opportunity to relieve the patient of a certain percentage of its weight. However, it requires that the weight of the patient is known beforehand and can be stated.

Alternatively to stating the weight of the patient, in one embodiment of the method the weight of the patient may be provided as a measured weight by the weight sensor.

One effect of this method may be to ascertain that the correct and updated weight of the patient is applied to the method. This may ensure that the training load to be exerted by the patient can be set independently from any weight gain or loss of the patient.

In one embodiment of the method, the electrical motor is limited to a maximum speed for unwinding the cable. This may be beneficial in regard to preventing fall accidents by slowly lowering the patient to the ground in case of missing foothold, tripping or loss of balance. This may further be advantageous in regard to avoiding or minimizing the risk of injury to care staff and therapists by reducing unconscious movements due to the urge to prevent the patient from falling.

The control unit may be adapted to execute the steps used in a method for training of neuromuscular functions.

One effect of this embodiment may be that the gait trainer may be operated in a dynamic mode and in a static mode.

In the static mode, the counterbalance weight may not be adjusted in response to the applied force by the patient. In the dynamic mode, the counterbalance weight may contrarily be adjusted in response to the applied force by the patient.

One effect of this embodiment may be to provide a training system wherein the patient may train natural movements but with a reduced body weight. This may previously have been accomplished by training in water, which may not be the optimal setting for patients being hospitalised, as full-body contact with water may not even be an option depending on the patient's complications.

The gait trainer may support standing exercises such as balancing, walking and/or running.

The gait trainer may be provided by incorporating the processor and the motor controller for executing the method steps in existing patient hoist systems having an electrical motor, a weight sensor and a cable being adapted as described above, as patient hoist systems are per se adapted for winding and unwinding a cable in order to perform lifting and lowering of a patient.

The cable may at the cable end be mounted with a buckle for further attachment to a sling, strap or comparable units adapted for holding the patient or to be worn by the patient. Such holding or wearing units may already be used in connection with existing patient hoist systems. Alternatively, new forms or shapes of holding or wearing units may be retrofitted to existing patient hoist systems by use of connecting units fitting with buckles of existing patient hoist systems.

In one embodiment, the gait trainer may comprise a weight sensor and a fixed suspension. The fixed suspension may comprise force balancing means. The weight sensor and the fixed suspension may be arranged side-mounted on the hoist system, such that the built-in height dimension of the gait trainer is reduced.

The fixed suspension holds the hoist system suspended. The fixed suspension can comprise throughgoing holes in a rail mount and the hoist system and a peg. The peg is mounted in the throughgoing holes.

On one side of the hoist system a weight sensor may be mounted. On another side of the hoist system a fixed suspension may be provided. In this case the fixed suspension comprises force balancing means, such that the total weight taken up by the fixed suspension and the weight sensor may be calculated from the measured weight on the weight sensor. The force balancing means may be peg around which the hoist system can rotate when the weight on the weight sensor is increased.

This embodiment may have the same effects and advantages of the gait trainer with two weight sensors, and may simply be considered an alternative embodiment.

One advantage on this embodiment compared to the gait trainer with two weight sensors may be cost-reduction of the system on component level. Another advantage may be easier installation of the hoist and a reduction in maintenance costs as a consequence.

In one embodiment of the gait trainer, the weight sensor(s) may comprise a load cell configured as a transducer of an applied force to an electrical signal being the qualitative weight sensor signal. The load cell may be a strain gauge load cell.

One effect of using a load cell is that a direct transfer of applied force to a quantitative electrical signal can be achieved. The electrical signal can then be used as input for the further communication between the units comprised in the gait trainer.

In one aspect, digital weighing cells based on strain gauge are used in the gait trainer. In a specific embodiment, digital weighing cells based on strain gauge of the type: HBM S40A/250 kg (Eilersen) may be used.

In one aspect, strain gauge-based load cells can be used in the gait trainer. In a specific embodiment, strain gauge-based load cells of the type: Zemic "H3G-C3-250 kg-6B" may be used.

The load cell may be chosen in accordance with the required capacity intended for the gait trainer with mechanical dimensions, which are in accordance with the mechanical dimensions to be obtained for the gait trainer and especially in consideration of a ceiling installed gait trainer. Further aspects such as industrial and medical equipment approvals may also be considered when choosing appropriate load cells.

Other aspects such as linearity and accuracy over the measuring interval of the load cell may be parameters to be considered.

Another aspect, which may be of importance, is the sampling rate, where a sampling rate of 20-1000 samples per second may be preferred since the change in applied force/weight may be dynamic.

In one embodiment, the gait trainer may comprise a rail mount adapted to interact with a ceiling rail and the one or more weight sensors. The weight sensor(s) may be connected to the rail mount at one end and to the hoist system at the other end, such that the hoist system is freely suspended by the weight sensor(s).

One effect of this embodiment may be to use the gait trainer with existing ceiling rails.

Using a ceiling hoist in conjunction with rehabilitation exercises can boost confidence and safety for user and therapist alike.

The user can feel more confident and can follow the therapist's instructions without fear of falling. The therapist can likewise provide help and guidance without risking back injury, should the patient suddenly overbalance and/or fall.

This can make it possible to perform more challenging exercises—and more of them. Hoist-assisted lifting as a part of rehabilitation programmes can be used at all mobility levels, and paves the way for flexible, closely targeted training adapted to suit the functional capabilities of the individual user.

Often, a ceiling-mounted hoist system may be suspended in two runners in the rail, thus with 2 load cells, the hoist may each be suspended in their own runner. Alternatively, the hoist system may be suspended with a weighing cell, which is connected to an exchange device between the two runners.

In one aspect, the gait trainer may be used with a driving motor to assist in a lateral direction e.g. for moving the gait trainer laterally during walking exercises. In this case, the use of two weight sensors for suspension of the hoist system may provide for detecting the direction in which the patient is moving, such that the hoist follows the patient assisted by the driving motor. Although the hoist may be moving very easily in the rail, one effect may be that the patient should not pull the hoist to conduct the training exercises.

The gait trainer may also comprise a breaking arrangement. The braking arrangement is adapted to break with an adjustable braking force. An adjustable braking force can be set by the braking arrangement.

The breaking arrangement allows the position of the hoist system in the ceiling rails to be fixed. This is the case, when a maximum brake force is set.

The breaking arrangement also allows a break force to be set to a level where the patient can move the hoist system in the ceiling rails, and the system provides resistance in form of the breaking force.

This enables more complex training exercises to be performed including a wider set of movements by the patient.

In one embodiment, the gait trainer may comprise a first and second ceiling rail mounted parallel to each other and a third ceiling rail connecting the first and the second ceiling rail and mounted slidingly in the first and second ceiling rails. The hoist system may be mounted slidingly to the third ceiling rail.

The ceiling rails allow the hoist system to be moved freely in a plane parallel with a ceiling. This allows a wider set of exercises to be performed with the patient. Especially in connection with the above-mentioned motor and/or braking arrangement.

In one embodiment of the gait trainer, the cable may comprise visible indications of the travel length of the cable for use during training sessions.

The visible indications may be used to describe the exercises to be performed by the patient. The exercises may include bending or stretching legs, feet and/or back and hence the exercises may be described by a change in height. By applying visual indications, the travel length may be used to instruct the patient and for the patient to repeat exercises and performing them correctly by visually following the displacement of the cable. The indications could include numbers, signs, colours, lines or comparable indications useable for such purpose.

In one embodiment, the gait trainer may comprise a hand-held controller for adjusting a length of the cable being unwind and/or rewind.

The handheld controller may comprise buttons for unwinding and rewinding the cable and/or for adjusting the counterbalance weight. This embodiment may have the effect that the patient and/or care staff or therapists may easily adjust the gait trainer for initiating the training session and also for adjusting the gait trainer during the session.

Thereby, the gait trainer may be adjusted in accordance with the progress of the exercises. The hand-held controller may have the effect that the patient can operate the gait trainer during training, for example in consultation with care staff or therapists to achieve a durable and optimised training.

In one embodiment, the gait trainer may comprise a graphic user interface adapted to display and/or receive an input of one or more values corresponding to values selected from the group consisting of counterbalance weight, weight of a patient, training load, actual applied weight.

The graphical user interface (GUI) may be used for making the settings of a training session, single exercises or a combination hereof. The input may on one hand be received as input from a user or operator of the gait trainer. The input may on the other hand be received as input from the gait trainer. The input may be received by selected input on the GUI, as data input, as electrical signals or comparable entries. Similar to the handheld controller and the visible indications, the GUI may be used to achieve the same effects and advantages of:

- describing the exercises to be performed by the patient,
- instructing the patient,
- following and repeating exercises,
- adjusting the gait trainer by unwinding and/or rewinding the cable and/or adjusting the counterbalance weight,
- adjusting the gait trainer for initiating the training session and during the training sessions,
- operating the gait trainer during training, for example in consultation with care staff or therapists to achieve a durable and optimised training
- etc.

In the case that an existing patient hoist system is retrofitted with the gait trainer, an existing graphical user interface may also be retrofitted accordingly to include displaying and/or receiving input of one or more values corresponding to values selected from the group consisting of counterbalance weight, weight of a patient, training load, actual applied weight.

In one aspect, the gait trainer may be operated via drop-down menus. These could be incorporated in existing GUIs or as stand-alone GUIs. Manoeuvring in the menus may be performed by interacting with a pressure-operated screen, the handheld controller or other adapted input means. The "mode" of the gait trainer may be displayed in the drop-down menus, such that the user always is informed of the present mode. In case of a gait trainer being retrofitted with an existing patient hoist system, the "mode" may display a gait training mode.

The GUI may also be used for choosing between values and setting the values comprised in the group consisting of counterbalance weight, weight of a patient, training load, actual applied weight.

An object of the invention may be achieved by a computer programme product comprising instructions to cause the gait trainer to execute the steps of the method for training of neuromuscular functions using the gait trainer.

The gait trainer may be provided by incorporating the method steps in existing patient hoist systems having a motor and a weight sensor. This may be achieved by retrofitting existing software with the computer programme product.

An object of the invention may be achieved by computer-readable media having stored thereon the computer programme product.

This embodiment may further support the effects and advantages of the gait trainer and the method for training of neuromuscular functions using the gait trainer.

DESCRIPTION OF THE DRAWING

Embodiments of the invention will be described in the figures, whereon.

DETAILED DESCRIPTION OF THE INVENTION

Figure 1:
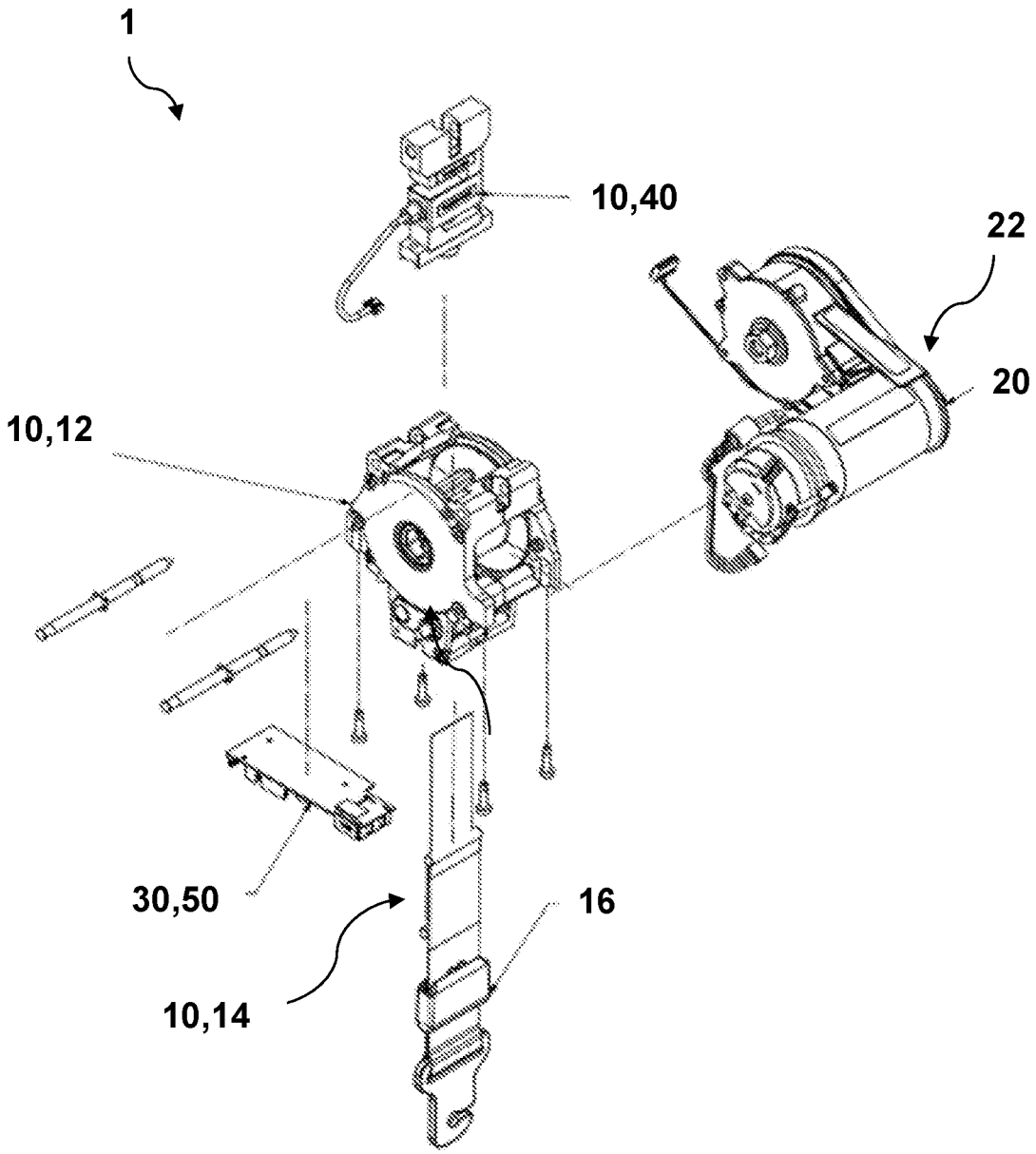
FIG. 1 illustrates one embodiment of the elements of the gait trainer.

1 gait trainer
10 hoist system
12 cable drum
14 cable
16 cable end
20 electrical motor
22 motor controller
30 control unit
32 motor drive control signal
40 weight sensor
42 weight sensor signal
50 processor
60 fixed suspension
62 force balancing means
70 rail mount
72 ceiling rail
73 first ceiling rail
74 second ceiling rail
75 third ceiling rail
92 graphic user interface
94 computer program product
96 computer-readable medium
100 method
102 determining
104 providing
106 measuring
108 comparing
110 instructing
112 calculating
202 counterbalance weight
204 weight of a patient
206 training load
208 actual applied weight
210 drive direction
250 braking arrangement FIG. 1 illustrates one embodiment of the elements of the gait trainer 1 for training of neuromuscular functions. The gait trainer 1 comprises a hoist system 10, which includes a rotatable cable drum 12 and a cable 14. The cable 14 may be adapted to be wound around the rotatable cable drum 12. The cable has a cable end 16 which may be adapted for interacting with a patient, here illustrated with a buckle mounted at the cable end 16 for further attachment to a sling, strap or comparable units adapted for holding the patient or to be worn by the patient.

The gait trainer 1 further comprises an electrical motor 20. The electrical motor may be adapted for axial engagement with the rotatable cable drum 12. The electrical motor may further be adapted to drive the rotatable cable drum 12 in a forward and in a reverse direction for unwinding or winding the cable 14 on the cable drum 12.

The gait trainer 1 further comprises a weight sensor 40, a processor 50 and a motor controller 22. The weight sensor 40 may be adapted for outputting a qualitative weight sensor signal to the processor 50. The weight sensor 40 may comprise a load cell configured as a transducer transforming an applied force to an electrical signal.

The processor 50 may be adapted for receiving the qualitative weight sensor signal and configured to calculate a motor drive control signal based on the received qualitative weight sensor signal. The processor 50 may be adapted for outputting the motor drive control signal to the motor controller 22. The motor controller 22 may comprise a gearing and be adapted to receive the motor drive control signal for establishing the calculated drive direction in the motor. The hoist system can be freely suspended by the weight sensor 40.

Figure 2:
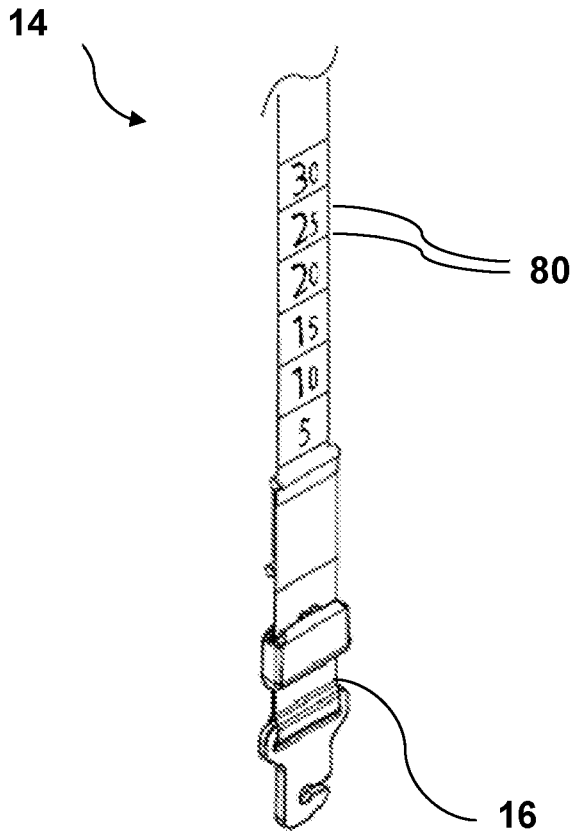
FIG. 2 illustrates one embodiment of the cable with visual indications.

FIG. 2 illustrates one embodiment of the cable 14 with visual indications 80. The cable 14 has a cable end 16 which may be adapted for interacting with a patient, here as in FIG. 1 illustrated with a buckle mounted at the cable end 16 for further attachment to a sling, strap or comparable units adapted for holding the patient or to be worn by the patient.

The visible indications may be used for measuring the actual the length of the unwinding or winding of the cable 14 and may be used for instructing the patient of exercises and for achieving a better repetition of exercises e.g. an exercise may be described as bending or stretching the legs to achieve a displacement of the cable of an interval of 10 cm, indication A-C etc. Here, the visual indications 80 are given as numbers and lines and could indicate the displacement in centimetres, however, other indications may be used.

Figure 3:
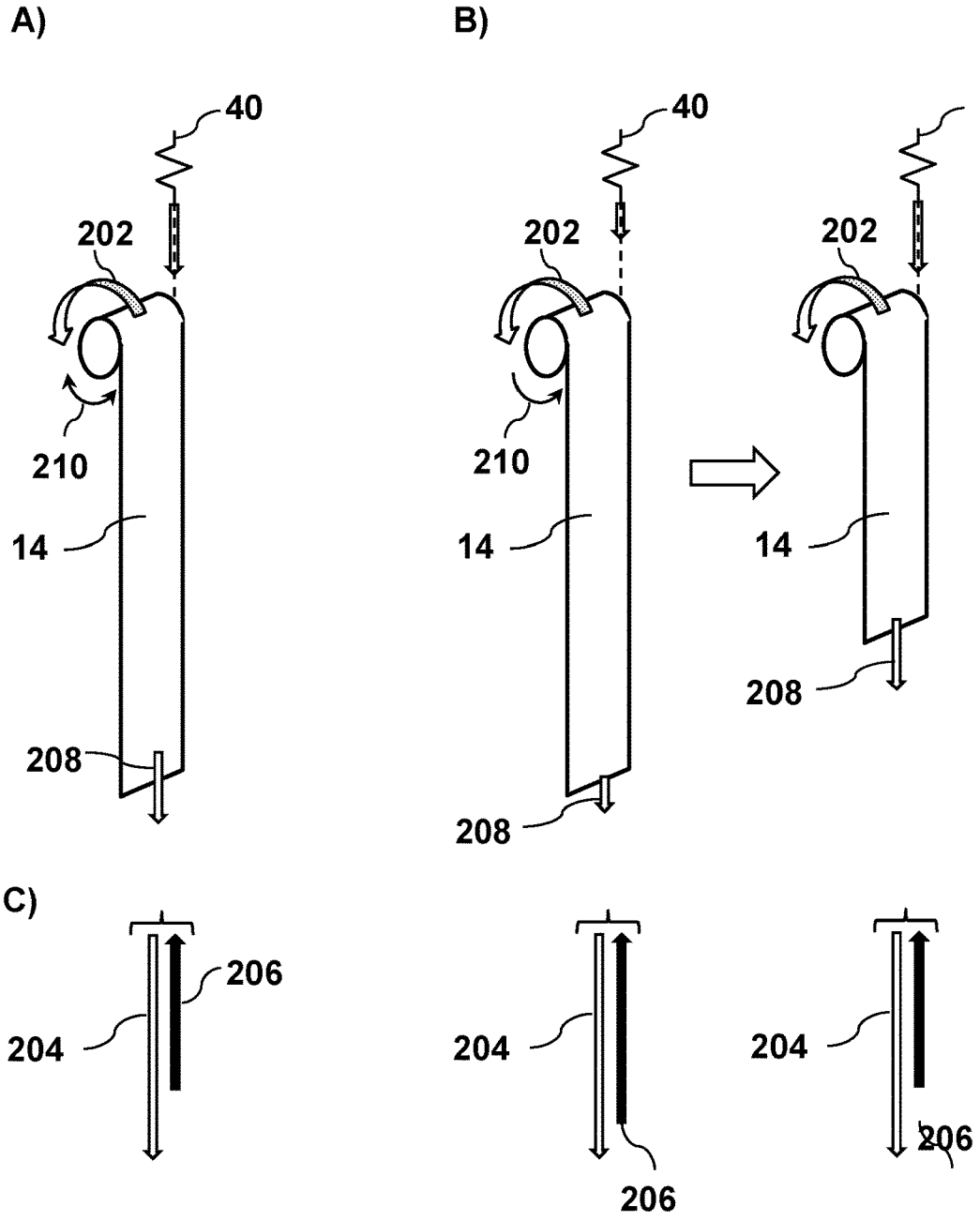
FIG. 3 illustrates the applied forces to the cable when the gait trainer is operated in respectively a dynamic mode and a static mode.

FIG. 3 illustrates the applied forces to the cable 14 when the gait trainer is operated in a dynamic mode. FIG. 3A illustrates how two counteracting forces are applied to the cable 14. A counterbalance weight 202 is applied to the cable 14 by the electrical motor and an actual applied weight 208 is applied to the cable 14 by the patient. The weight sensor 40 measures the actual applied weight 208 applied to the cable 14 by the patient.

Depending on the two values of the counteracting forces 202, 208 applied to the cable 14 and how they balance out, a drive direction 210 of the electrical motor comprised in the gait trainer is determined. If the counteracting forces balance, then the drive speed may be set to zero.

FIG. 3B illustrates the case where the actual applied weight 208 applied to the cable 14 by the patient is lower than the counterbalance weight 202 applied to the cable 14 by the electrical motor. In this case, the drive direction 210 of the electrical motor comprised in the gait trainer is set to reduce the length of the cable until the actual applied weight 208 applied to the cable 14 by the patient equals the set counterbalance weight 202. This may be the case where a patient goes from a bending position to a stretched position e.g. back or legs, by changing from flat foot position to toe position, climbing a step or comparable exercises.

FIG. 3C illustrates how a weight of a patient 204 may be provided and a training load 206 exerted by the patient results in the actual applied weight 208 applied to the cable 14 by the patient.

Figure 4:
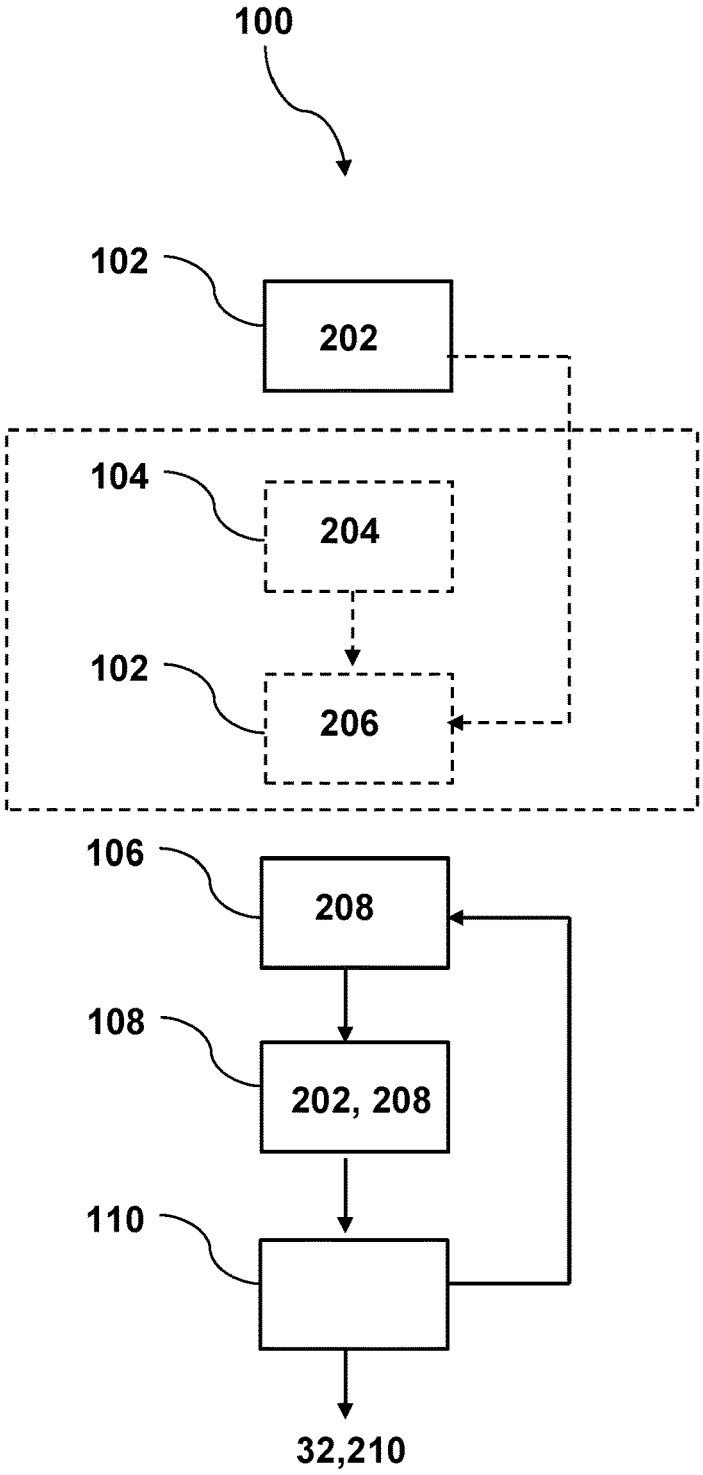
FIG. 4 illustrates one embodiment of the method for training of neuromuscular functions using a gait trainer.

FIG. 4 illustrates two embodiments of the method 100 for training of neuromuscular functions using the gait trainer.

One embodiment is illustrated, which comprises the acts illustrated with full lines. This method comprises the acts of determining 102 a counterbalance weight 202 to be applied to the cable by the electrical motor and continuously performed acts of measuring 106 with the weight sensor an actual applied weight 208 to the cable by the patient, comparing 108 the actual applied weight 208 with the determined counterbalance weight 202, and instructing 110 a motor controller of a drive direction 210 by giving a motor drive control signal 32. The drive direction 210 is based on the result of comparing the actual applied weight 208 with the determined counterbalancing weight. These continuously performed acts may be performed until the determined counterbalance weight 202 applied to the cable by the electrical motor and the actual applied weight 208 balances but in such a way that the counterbalance weight 202 is maintained at a constant value.

The other embodiment illustrated in FIG. 4 comprises, in addition to the acts illustrated with full lines and described above, the further acts illustrated by the dotted lines. This embodiment comprises a further act of providing 104 a weight of a patient 204 and an act of determining 102 a training load 206 to be exerted by the patient, wherein the training load 206 is determined by the difference between the provided weight of the patient 204 and the determined counterbalance weight 202.

Figure 5:
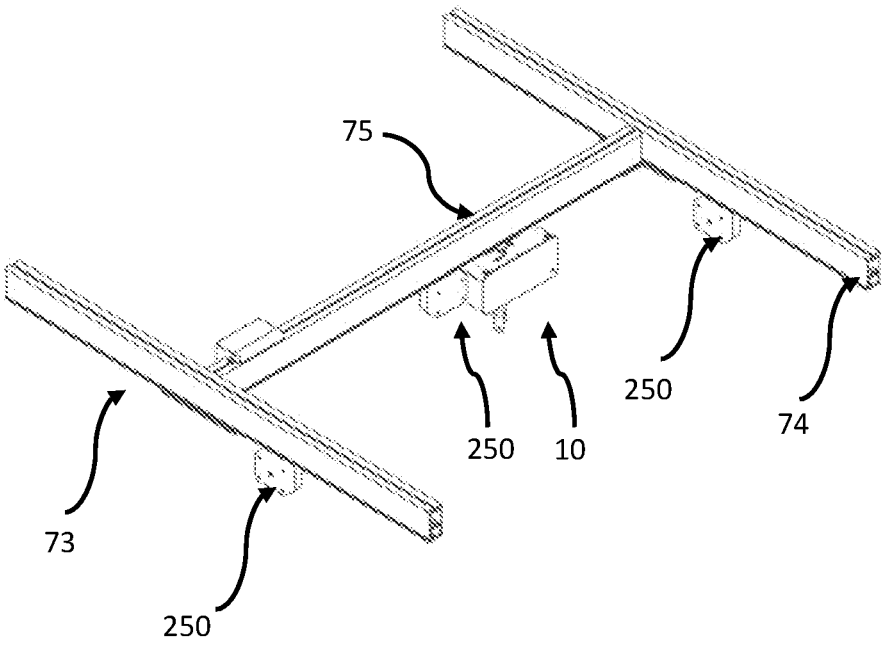
FIG. 5 illustrates one embodiment of the elements of the gait trainer with brakes and drive motor.

FIG. 5 shows a gait trainer comprising a breaking arrangement 250. An adjustable braking force can be set by the braking arrangement 250.

The breaking arrangement 250 allows the position of the hoist system 10 in the ceiling rails 72 to be fixed. This is the case, when a maximum brake force is set.

The breaking arrangement 250 also allows a breaking force to be set to a level where the patient can move the hoist system 10 in the ceiling rails 72, and the system provides resistance in form of the breaking force.

This enables more complex training exercises to be performed including a wider set of movements by the patient.

The gait trainer comprises a first 73 and second ceiling rail 74 mounted parallel to each other and a third ceiling rail 75 connecting the first and the second ceiling rail and mounted slidingly in the first and second ceiling rials. The hoist system is mounted slidingly to the third ceiling rail 75.

The ceiling rails allow the hoist system to be moved freely in a plane parallel with a ceiling. This allows a wider set of exercises to be performed with the patient. Especially in connection with the above-mentioned motor and/or braking arrangement.

Figure 6:
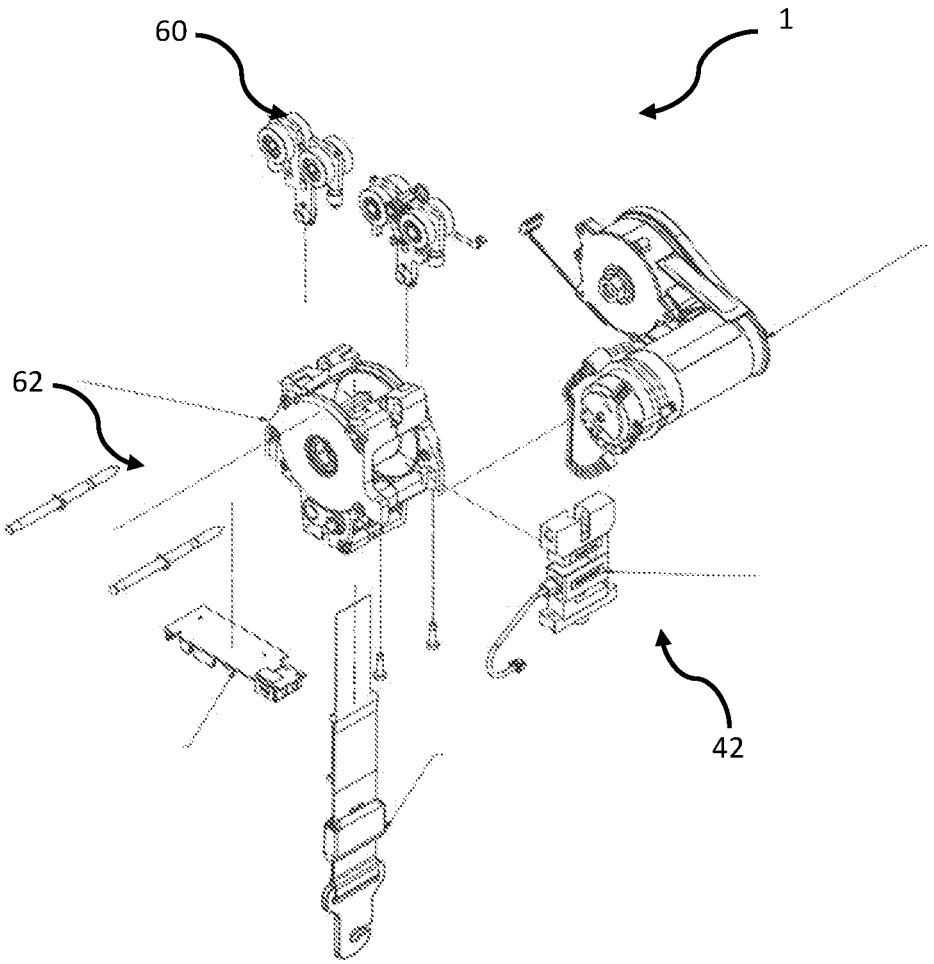
FIG. 6 illustrates one embodiment of the elements of the gait trainer.

FIG. 6 shows an embodiment of the gait trainer comprising a weight sensor 40 and a fixed suspension 60. The fixed suspension 60 comprises force balancing means 62. The weight sensor 40 and the fixed suspension 60 are arranged side-mounted on the hoist system, such that the built-in height dimension of the gait trainer is reduced.

The fixed suspension holds the hoist system suspended. The fixed suspension comprises throughgoing holes in a rail mount and the hoist system and a peg. The peg is mounted in the throughgoing holes.

On one side of the hoist system a weight sensor is mounted. On another side of the hoist system a fixed suspension is provided. The fixed suspension comprises force balancing means, such that the total weight taken up by the fixed suspension and the weight sensor may be calculated from the measured weight on the weight sensor. The force balancing means comprises a peg around which the hoist system can rotate when the weight on the hoist system is increased.

The invention claimed is:

1. A gait trainer for training of neuromuscular functions comprising:

a hoist system including a rotatable cable drum, a cable sized to wind around the rotatable cable drum including a cable end adapted for interaction with a patient;

an electrical motor adapted for axial engagement with the rotatable cable drum and adapted to drive said rotatable cable drum in a forward and in a reverse drive direction for unwinding or winding the cable on the cable drum;

one or more weight sensors configured to output a qualitative weight sensor signal;

a control unit;

a processor configured to receive the qualitative weight sensor signal, said processor also being configured to calculate and output a motor drive control signal, a motor controller configured to receive the motor drive control signal wherein the processor is adapted for establishing the calculated drive direction in the motor based on the received qualitative weight sensor signal and base on the result of comparing the actual qualitative weight signal with a counterbalance weight determined prior to beginning the training, and wherein said motor controller is adapted to establish the calculated drive direction in the motor such that the determined counterbalance weight applied to the cable by the electrical motor is maintained at a constant value, and wherein the hoist system is freely suspended by the weight sensors as the gait trainer comprises two weight sensors wherein the weight sensors are arranged side-mounted on the hoist system, such that the built-in height dimension of the gait trainer is reduced.

2. A gait trainer according to claim 1 further comprising a fixed suspension with force balancing means wherein the one or more weight sensors and the fixed suspension are arranged side-mounted on the hoist system, such that the built-in height dimension of the gait trainer is reduced.

3. A gait trainer according claim 1 wherein the one or more weight sensors comprise a load cell configured as a transducer of an applied force to an electrical signal being the qualitative weight sensor signal, wherein said load cell is a strain gauge load cell.

4. A gait trainer according to claim 1 further comprising a rail mount adapted to interact with a ceiling rail and the one or more weight sensors, said weight sensor connected to the rail mount at one end and to the hoist system at the other end, such that the hoist system is freely suspended by the one or more weight sensors.

5. A gait trainer according to claim 1, wherein the cable comprises visible indications of the travel length of the cable for use during training sessions.

6. A gait trainer according to claim 1 further comprising a handheld controller for adjusting a length of the cable being unwind and/or rewind.

7. A gait trainer according to claim 1 further comprising a graphic user interface adapted to display and/or receive an input of one or more values corresponding to values selected from the group consisting of counterbalance weigh, weight of a patient, training load, actual applied weight.

8. A gait trainer according to claim 1 a breaking arrangement, which braking arrangement is adapted to break with an adjustable braking force.

9. A computer programme product comprising instruction to cause the gait trainer according to claim 1 to execute the steps of a method for training of neuromuscular functions using a gait trainer comprising an electrical motor, a weight sensor and a cable, said method comprises acts of:

Determining a counterbalance weight to be applied to the cable by the electrical motor;

Continuously performing the acts of:

Measuring with the weight sensor an actual applied weight to the cable by the patient;

Comparing the actual applied weight with the determined counterbalance weight, and Instructing a motor controller of a drive direction by giving a motor drive control signal for establishing the calculated drive direction in the motor based on the result of comparing the actual applied weight with the determined counterbalancing weight determined prior to beginning the training, such that the determined counterbalance weight applied to the cable by the electrical motor is maintained at a constant value.

10. A computer programme product according to claim 9 where the method further comprises the acts of:

Providing a weight of a patient;

Determining the counterbalance weight as a percentage of the provided weight of the patient, such that the difference between the provided weight of the patient and the counterbalance weight is a training load to be exerted by the patient.

11. A computer programme product according to claim 10, wherein the weight of the patient is provided as a measured weight by the weight sensor.

12. A computer programme product according to claim 9 wherein the electrical motor is limited to a maximum speed for unwinding the cable to prevent fall accidents.

13. A computer-readable medium having stored thereon the computer programme product of claim 9.

14. A method for using a gait trainer comprising an electrical motor, a weight sensor and a cable, said method comprises acts of:

Determining a counterbalance weight to be applied to the cable by the electrical motor;

Continuously performing the acts of:

Measuring with the weight sensor an actual applied weight to the cable;

Comparing the actual applied weight with the determined counterbalance weight, and Instructing a motor controller of a drive direction by giving a motor drive control signal to the motor for establishing the calculated drive direction in the motor based on the result of comparing the actual applied weight with the determined counterbalancing weight determined prior to beginning the training, such that the determined counterbalance weight applied to the cable by the electrical motor is maintained at a constant value.

* * * * *